United States Patent [19]

Gillis

[11] 4,099,533

[45] * Jul. 11, 1978

[54] CONCAVE-CONVEX STRUCTURE WITH SPACED FITTINGS FOR INTERSECTING FLEXIBLE RODS

[76] Inventor: Robert E. Gillis, P.O. Box 67, Aptos, Calif. 95003

[ * ] Notice: The portion of the term of this patent subsequent to Oct. 19, 1993, has been disclaimed.

[21] Appl. No.: 728,182

[22] Filed: Sep. 30, 1976

Related U.S. Application Data

[63] Continuation-in-part of Ser. No. 614,445, Sep. 18, 1975, Pat. No. 3,986,519.

[51] Int. Cl.[2] ..... A45F 1/16

[52] U.S. Cl. ..... 135/3 E; 24/73 PF; 24/DIG. 17; 135/15 CF; 135/8

[58] Field of Search ..... 135/3 E, 15 CF, 8; 24/73 PF, DIG. 17

[56] References Cited

U.S. PATENT DOCUMENTS

| | | | |
|---|---|---|---|
| 1,880,845 | 10/1932 | Czop | 24/DIG. 17 |
| 2,186,535 | 1/1940 | MacGeorge | 135/8 X |
| 2,364,266 | 12/1944 | Bryce | 24/DIG. 17 |
| 2,548,004 | 4/1951 | Duefrene | 24/DIG. 17 |
| 3,498,305 | 3/1970 | Hulin | 135/8 X |

OTHER PUBLICATIONS

The North Face Catalog, p. 31, 1975.

*Primary Examiner*—Werner H. Schroeder
*Assistant Examiner*—Conrad L. Berman
*Attorney, Agent, or Firm*—Robert G. Slick

[57] ABSTRACT

A concave-convex structure is composed of a plurality of pole or rod elements including at least two series of rows of such rods, the rods of each row being substantially parallel to one another. The rows are intersecting, but are uniform in respective orientation. The rods are stabilized at the intersections by fittings which permit relative sliding movement of restricted degree. These fittings are secured to a flexible membrane or body portion.

Modification of the fittings to provide multiple layer body portions is achieved through the application of spaced layers of material.

13 Claims, 8 Drawing Figures

FIG. 1
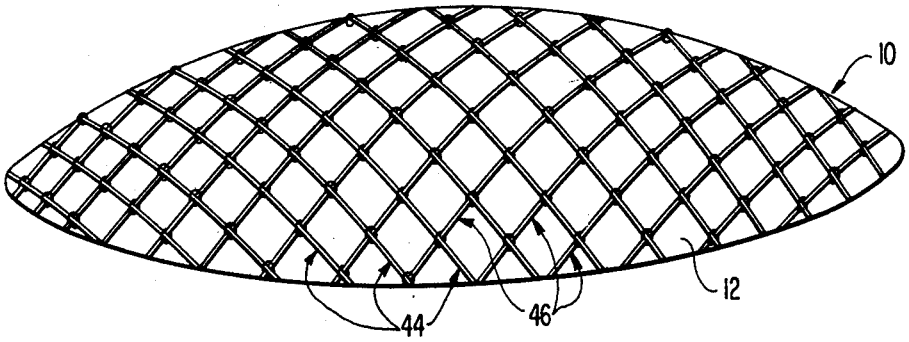
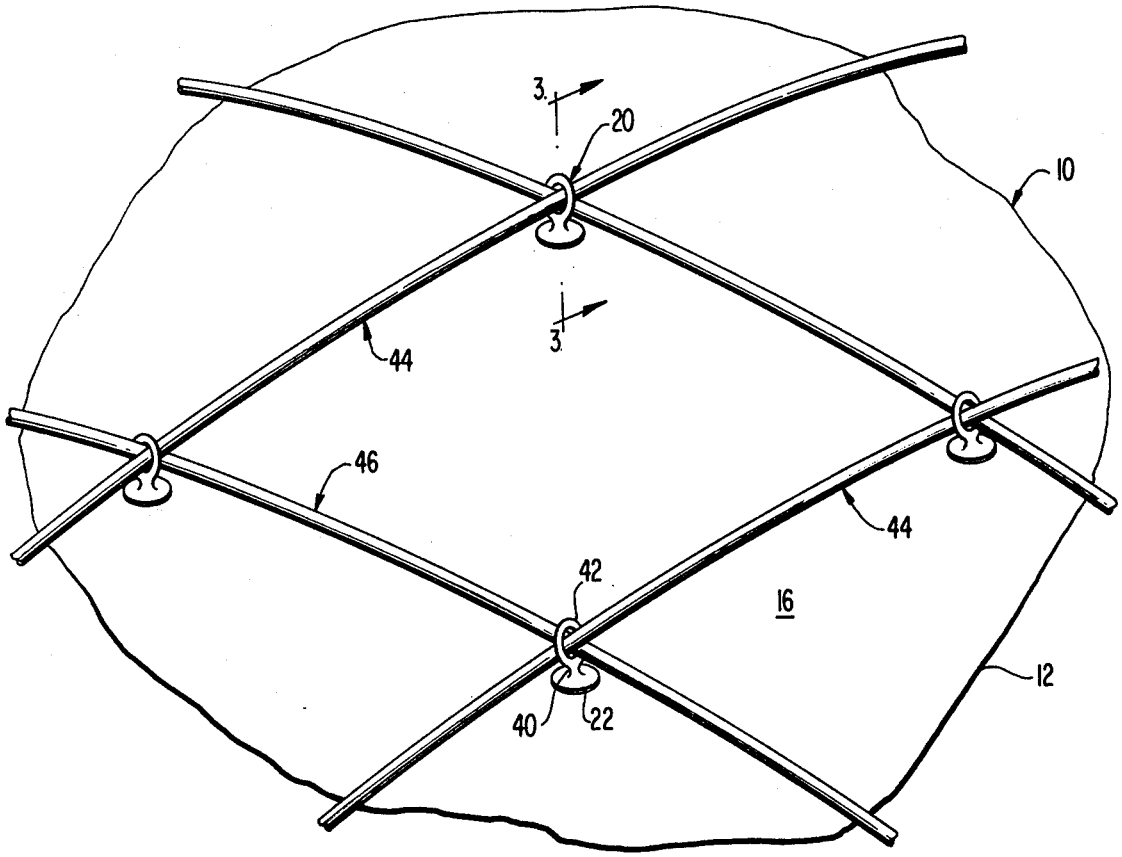
FIG. 2

FIG. 3
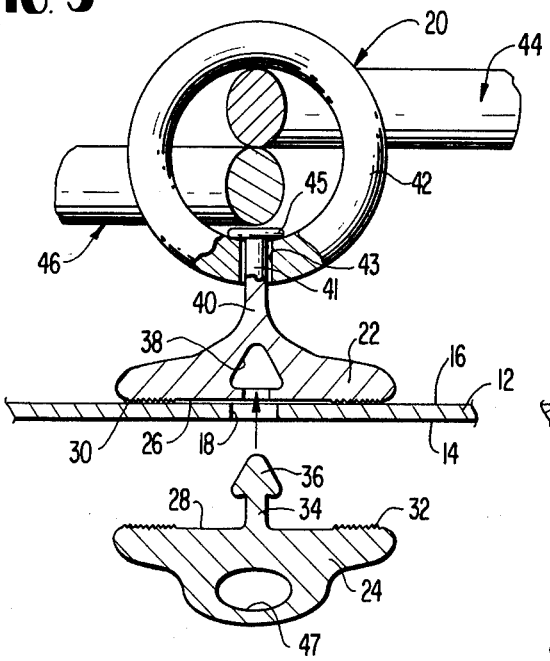
FIG. 4
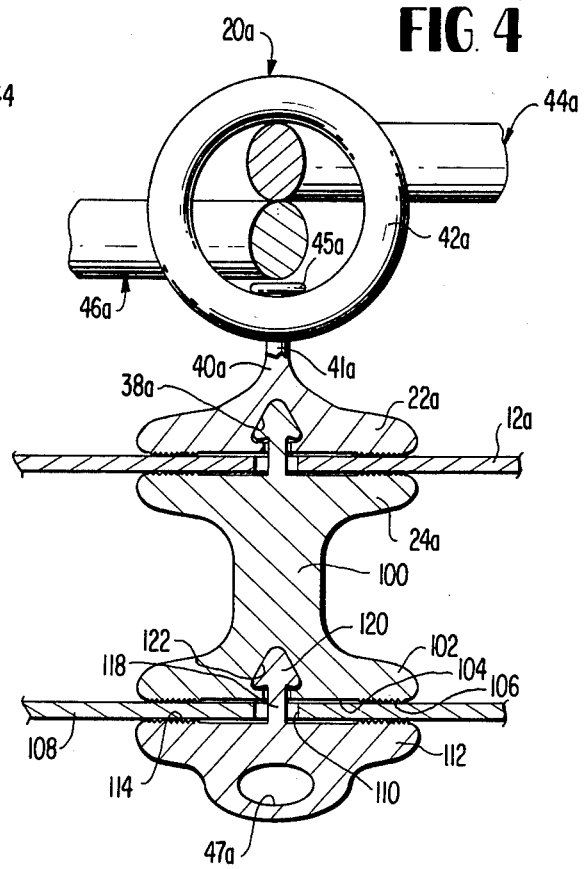
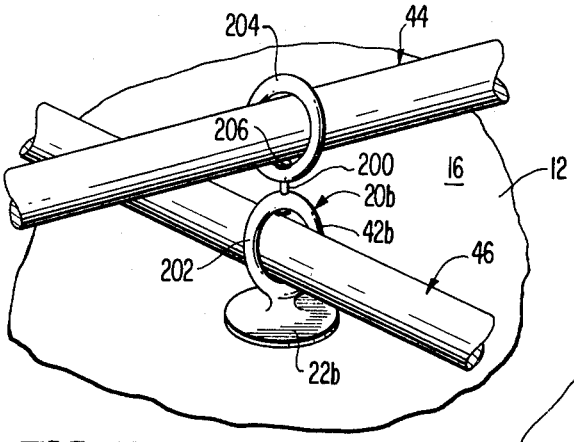
FIG. 5
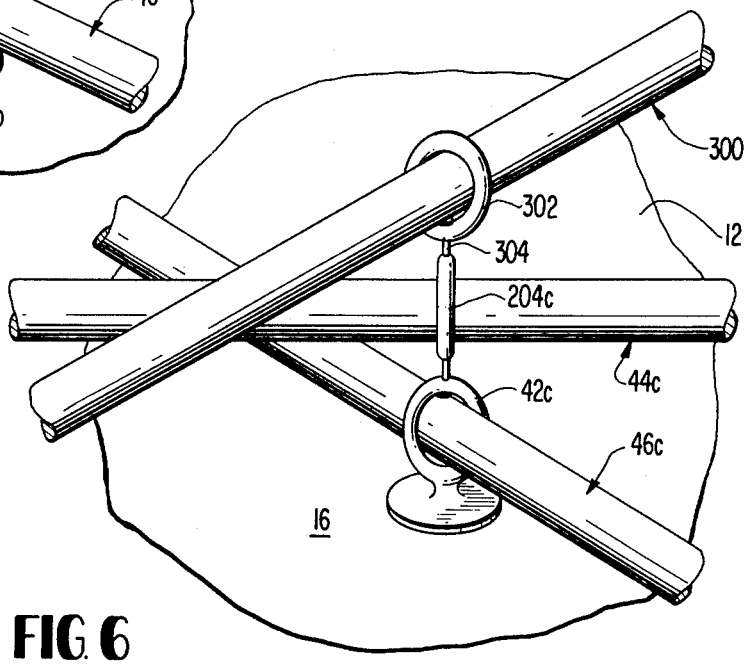
FIG. 6

CONCAVE-CONVEX STRUCTURE WITH SPACED FITTINGS FOR INTERSECTING FLEXIBLE RODS

REFERENCE TO RELATED APPLICATION

This application is a continuation-in-part of my application Ser. No. 614,445 filed Sept. 8, 1975, now U.S. Pat. No. 3,986,519.

BACKGROUND OF THE INVENTION

1. Field of the Invention

This invention relates to a flexible structure having a broad range of utility. Illustratively, the structure may be embodied in a tent or enclosure, a kite, a boat, or other environments wherein a concave-convex body is employed.

2. Statement of the Prior Art

This invention is to some extent an extension or improvement on the subject matter shown in my prior U.S. Pat. No. 3,863,659. Other pertinent prior patents known to me include the following:

| Patent No. | Patentee | Issued |
|---|---|---|
| 2,914,074 | Fuller | Mar. 1, 1957 |
| 3,006,670 | Schmidt | Oct. 31, 1961 |
| 3,269,398 | Holbitz | Aug. 30, 1966 |
| 3,710,806 | Kelly et al. | Jan. 16, 1973 |
| 3,744,191 | Bird | Jly. 10, 1973 |
| 3,838,703 | Zeigler | Oct. 1, 1974 |

SUMMARY OF THE INVENTION

The present invention provides a concave-convex structure of unlimited utility and features a flexible membrane or body portion having a series of rods or poles arranged in intersecting rows. These are stabilized at intersection points by fittings which permit slidable movement. Such sliding movement may be effected in several manners, but preferably is through the use simply of an annular element of sufficient dimension to accomodate the poles in sliding fashion.

The structure provided hereby is characterized by a substantial strength to weight ratio in relation to its enclosed volume. This is believed to result from a synergetic inter-action between the outwardly stressed poles or rods, and the annular elements secured to the membrane. The slidable nature of the association of these components, with the annular elements attached to the membrane, permits the formation of multi-faceted, complex structures with ease and speed. Such structures are easily disassembled as well.

Other and further objects and advantages of the invention will become apparent to those skilled in the art from a consideration of the following specification when read in conjunction with the annexed drawings.

BRIEF DESCRIPTION OF THE DRAWINGS

FIG. 1 is a perspective view of a dome-like structure formed in accordance with the present invention;

FIG. 2 is an enlarged fragmentary view of the structure;

FIG. 3 is a further enlarged sectional view taken substantially on line 3 — 3 of FIG. 2, looking in the direction of the arrows;

FIG. 4 is a view similar to FIG. 3 showing a modification employed in forming a multi-layer structure;

FIG. 5 is another fragmentary top perspective view showing a first modified form of intersection;

FIG. 6 shows another type of crossover;

DESCRIPTION OF THE PREFERRED EMBODIMENTS

Figure 7:
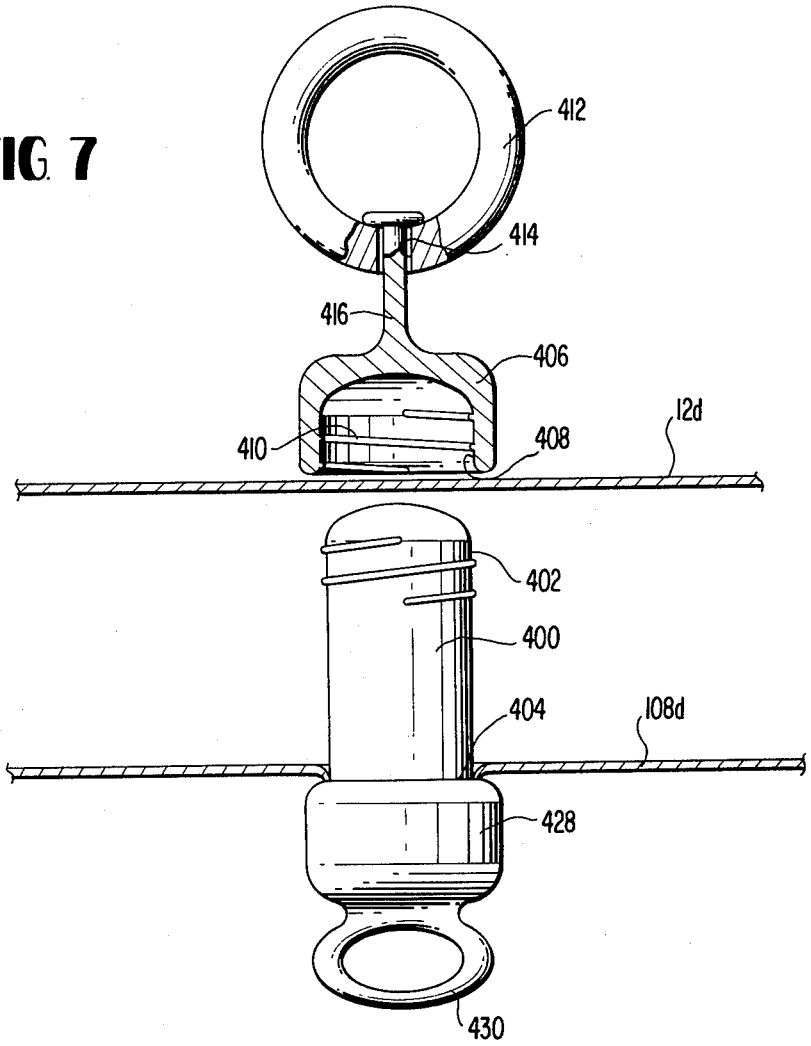
FIG. 7 discloses another modification.

The dome shown in FIG. 1 and identified by reference character 10 is representative of the forms in which the structure hereof may be embodied. The tent-like form is of a broad range of utility as an enclosure. Other environments of employment of the structure are set forth herein-above.

A basic component of the structure is a flexible membrane or sheath 12 having an inner surface 14 and an outer surface 16. The membrane is formed of plastic or other material and has the characteristic of being stretchable in multiple directions. Throughout its extent the membrane has connection locations such as apertures 18 formed therein, said apertures being arranged in rows.

FIGS. 2 and 3 disclose a first basic form of fitting assembly 20 hereof. A fitting assembly 20 is provided for each of the apertures. The assemblies 20 each comprise an outer base 22 and an inner base 24. The bases have inside walls 26, 28, respectively, provided about their outer circumferences with projecting teeth 30 and 32. These teeth grip the material of the membrane to insure a tightly sealed relation between the fitting and the membrane. The fitting further includes means extending through the aperture to clampingly secure the fitting to the membrane. In FIG. 3, such means is shown as comprising a shaft 34 extending vertically from the inner base 24. The shaft has an enlarged, tapered plug 36 on its outer end. Formed in the outer base 22 is a chamber 38 shaped to correspond to the configuration of the shaft 34 and plug 36. The fitting is of rubber or a similar material, and thus, the plug is engageable in the chamber. The plug and shaft are extended through the aperture and into engagement in the chamber, thus locking the bases on opposite sides of the membrane.

Extending vertically from the outer base 22 is a vertical stem 40. The stem is provided with a plug 41 similar to the plug 36. The plug 41 is detachably seated in a chamber 43 formed in an upper stem section 45. An enlarged annular ring member 42 is mounted on the upper stem section 45. This permits detachment of the fitting from the membrane without complete dis-assembly thereof. The fitting is rotatable to permit variance in the orientation of the ring member, for accomodation of the intersecting rods at varous angles.

The base 24 is formed with an interior hole 47 from which items may be suspended.

The invention has, as an important structural feature thereof, two intersecting series of support rods which co-act with the membrane 12 and fittings 20 to form the structure hereof. This includes a first series of rods 44 which extend substantially parallel to one another, and a second series of rods 46, also mutually generaly parallel. The rods of each series are constructed of material, such as a solid resinous substance, which is rigid and yet permits flexation. The rods are flexed in arch form during assembly and are of varying lengths depending upon location.

The rods are positioned along the rows of apertures, and extend in sliding relation through the ring member 42 of the fittings. The rods of the second series 46 intersect those of the first series and pass under those of the first series, there being a relatively close fit through the ring members 42. This establishes a stabilized condition between the membrane, the fittings and the rods.

FIG. 4 shows a modified form of fitting, components corresponding to those in the first described form being identified by like reference characters with a letter "*a*" appended thereto. The fittings 20*a* have an outer base 22*a* which is snap fit to an inner base 24*a*. Depending integrally from the inner base is a spacer extension 100 having a disc member 102 thereof. The disc member 102 has a flat lower face 104 with teeth 106 and contacts an inner membrane layer 108 about an aperture 110 therein. The apertures 110 in the inner membrane layer are vertically aligned with the apertures of the outer layer. The disc member 102 is secured to the inner membrane layer 108 by a lower disc 112 having an inside face 114 with teeth 116, and having a prong 118 with an enlarged head 120 — a suspension hole 47*a* being provided therein. The prong and head extend through the aperture 110 and seat in a correspondingly shaped socket 122 formed in the disc 102. The second form of the invention threfore provides for two layers of membrane, for insulation or added strength.

In FIG. 5, still another modification is shown. Here, the intersection of the rods from the first and second series thereof is accomplished with a fitting 20*b* similar to the fitting 20. The ring member 42*b* is of reduced diameter however and will accommodate only a single rod. A swivel pin 200 is extended through an opening formed in the top of the ring member, and has an enlarged end 202 to prevent withdrawal. A second ring member 204 has an opening in its lower end, and the pin extends therethrough again having an enlarged end 206. This constitutes another means to permit limited relative sliding movements of the rods at their intersection points.

In some configurations of a more complex nature than the basic concave-convex form shown in FIG. 1, additional series of rods may be required. FIG. 6 illustrates an embodiment wherein three intersecting series of rods 44*c*, 46*c* and 300 are employed. There a third ring ring member 302 is added above the ring members 204*c* and 42*c*. This is accomplished through a swivel pin 304 identical to the pin 200 described above. This arrangement may be further modified by adding rings to provide for any number of tiers of rods.

FIG. 7 shows yet another form in which the membrane 12*d* is imperforate. Fittings 20*d* comprise a central body 400 having shallow outwardly threaded end portions 402 and 404. An upper body 406 has a socket 408 with threads 410 interfitting with the end portion 402. A ring member 412 has a base 414 which seats against a corresponding stem 416 on the upper body. Both the base and stem 414, 416 have sockets therein 418, 420 which receive a connector 422 with enlarged socket engaging heads 424 and 426. Thus, the ring member 412 is detachable from the body 406. A lower body 428 is formed with a threaded socket (not specifically shown) and has a depending oval ring 430. This central body 400 engages the imperforate outer membrane 12*d* and clampingly engages it in the socket 408 between the loosely fitting screw threads, while the lower body socket is clamped to the inner membrane 108*d* in similar fashion. The connection is established at connection locations which are suitably determined on the respective membranes.

Figure 8:
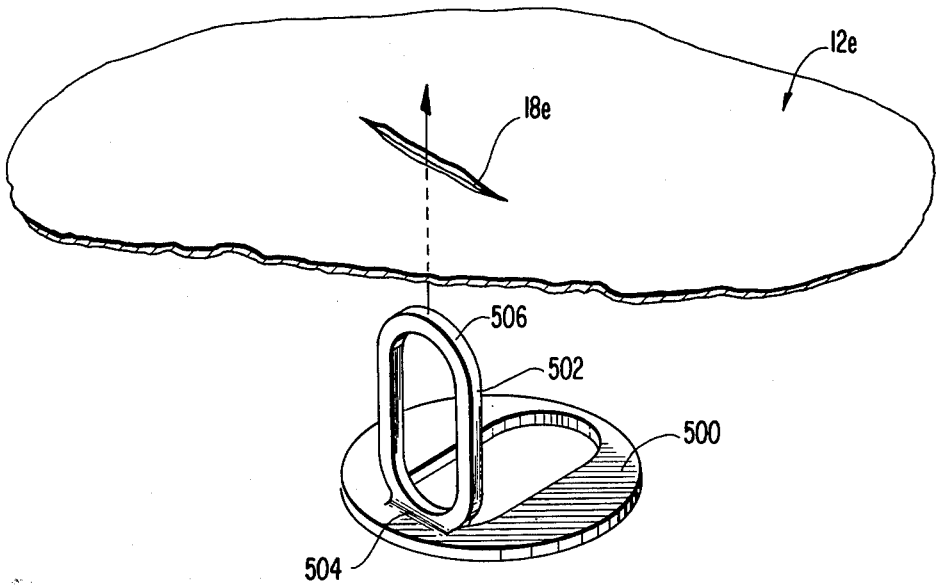
FIG. 8 shows still another form of intersection.

Finally, in FIG. 8 a non-complex form of fitting 20*e* is used wherein the member 12*e* is formed with slits 18*e* comprising the connection locations. The fittings comprise discoidal bases 500 having a punched or struck tab 502. The tab includes a stem 504 bent to substantially perpendicular relation to the base and having a ring member 506. The tabs extend through the slits 18*e* to receive the appropriate poles.

I claim:

1. A flexible, dome structure extending outwardly from a plane surface comprising in combination:

a. a plurality of continuous stressed poles, each having an arch configuration with the terminal ends of said poles defining said plane surface and the intermediate portions defining the surface of the dome, b. the terminal ends of said poles being distributed around said plane surface to produce a plurality of pole crossings, c. a flexible membrane lying under said poles and following the general configuration of said dome, d. attachment means attaching said membrane to said poles at each pole crossing, said attachment means including at least one loop element slidably engaging a plurality of poles at a crossing and attached to a fixed point on said membrane, said membrane stressing said poles into said arch configuration.

2. The structure of claim 1 wherein said poles are arranged in a plurality intersecting rows.

3. The structure of claim 1 wherein said attaching means pass through apertures in said membrane.

4. The structure of claim 1 wherein said attachment means comprises a loop encircling a plurality of poles at a crossing and attached to said membrane by a flexible member.

5. The structure of claim 1 wherein said poles are of varying lengths.

6. The structure of claim 1 wherein the loop element engaging said poles comprises first and second rings, each encircling a single pole adjacent a crossing, connecting means for connecting said first and second rings together, said rings each being swivelably connected to said connecting means.

7. The structure of claim 1 having three series of intersecting poles.

8. A dome structure comprising a plurality of upward-convex stressed continuous rods, said rods crossing each other at a plurality of intersections spaced from each other at different locations on the dome, first means at at least some of said intersections holding said rods in intersecting relationship to each other in a manner such that said rods may slide relative to each other and may move inward and outward relative to said dome through slight amplitudes of movement, a membrane under said rods, and second means connected to each of said first means and to said membrane at fixed points on said membrane to support said membrane from said rods.

9. A dome structure according to claim 8 in which said membrane is a flexible fabric.

10. A dome structure according to claim 8 in which said first means comprises a ring.

11. A dome structure according to claim 8 in which the termini of said rods are substantially coextensive with the marginal edges of said membrane at fixed points spaced around the periphery of said membrane.

12. A dome structure comprising a plurality of continuous stressed rods, each rod being of arcuate shape, said rods crossing each other at a plurality of intersections, a flexible membrane beneath said rods, means at substantially all of said intersections attached to said membrane holding said rods in intersecting relationship and for allowing slideable movement of said rods relative to each other and said membrane, and second means supporting said membrane at fixed points on said membrane from each of said first means.

13. A dome structure comprising a plurality of stressed rods each rod being flexed into an arcuate shape to exert a force in a direction which is radially outward of said each rod, said rods crossing each other at a plurality of intersections, a flexible membrane beneath said rods, means attached to said membrane holding said rods in intersecting relationship at each of said plurality of intersections said means engaging each of said rods at both sides of and immediately adjacent to the point of intersection of said rods and allowing slidable movement of said rods relative to each other at said intersections and relative to said membrane, said means supporting said membrane spaced apart from said rods and transmitting said outwardly directed force to said membrane.

* * * * *